United States Patent [19]

Krogsrud

[11] 4,434,496

[45] Feb. 28, 1984

[54] HOLDER ASSEMBLY FOR AN ELECTRODE IN AN ELECTROTHERMAL SMELTING FURNACE

[76] Inventor: Harald Krogsrud, Baerumsveien 447, 1346 Gjettum, Norway

[21] Appl. No.: 281,687

[22] Filed: Jul. 9, 1981

[30] Foreign Application Priority Data

Jul. 25, 1980 [NO] Norway ..... 802264

[51] Int. Cl.[3] ..... H05B 7/10; H05B 7/11

[52] U.S. Cl. ..... 373/96; 373/101

[58] Field of Search ..... 373/94, 95, 96, 100, 373/101

[56] References Cited

U.S. PATENT DOCUMENTS 1,892,109 12/1932 Marshall ..... 373/100

2,911,455 11/1959 Olsson et al. ..... 373/100

FOREIGN PATENT DOCUMENTS 1022332 1/1958 Fed. Rep. of Germany ..... 373/96

*Primary Examiner*—Roy N. Envall, Jr.

[57] ABSTRACT

The present invention relates to a holder assembly for electrodes in an electrothermal smelting furnace. The holder assembly comprises a plurality of contact clamps which are pressed towards the electrode by means of pressure producing means and an externally arranged thrust member. The holder assembly is further equipped with means for communicating current, coolant and pressure agent to the contact clamps. The holder assembly is constructed as a single integrated unit where current, coolant and pressure agent are conducted through the same supply pipes. The supply pipes serve additionally as support for the holder and consequently the electrode. The pressure producing means is constructed as an integral part of the contact clamps while the supply pipes are welded on to the contact clamps. The holder assembly has a total outer diameter which is less than the internal diameter of the suspension casing, whereby the entire holder assembly may be lifted up or lowered down inside the suspension casing during maintenance or substitution of the holder assembly.

8 Claims, 2 Drawing Figures

HOLDER ASSEMBLY FOR AN ELECTRODE IN AN ELECTROTHERMAL SMELTING FURNACE

Figure 1:
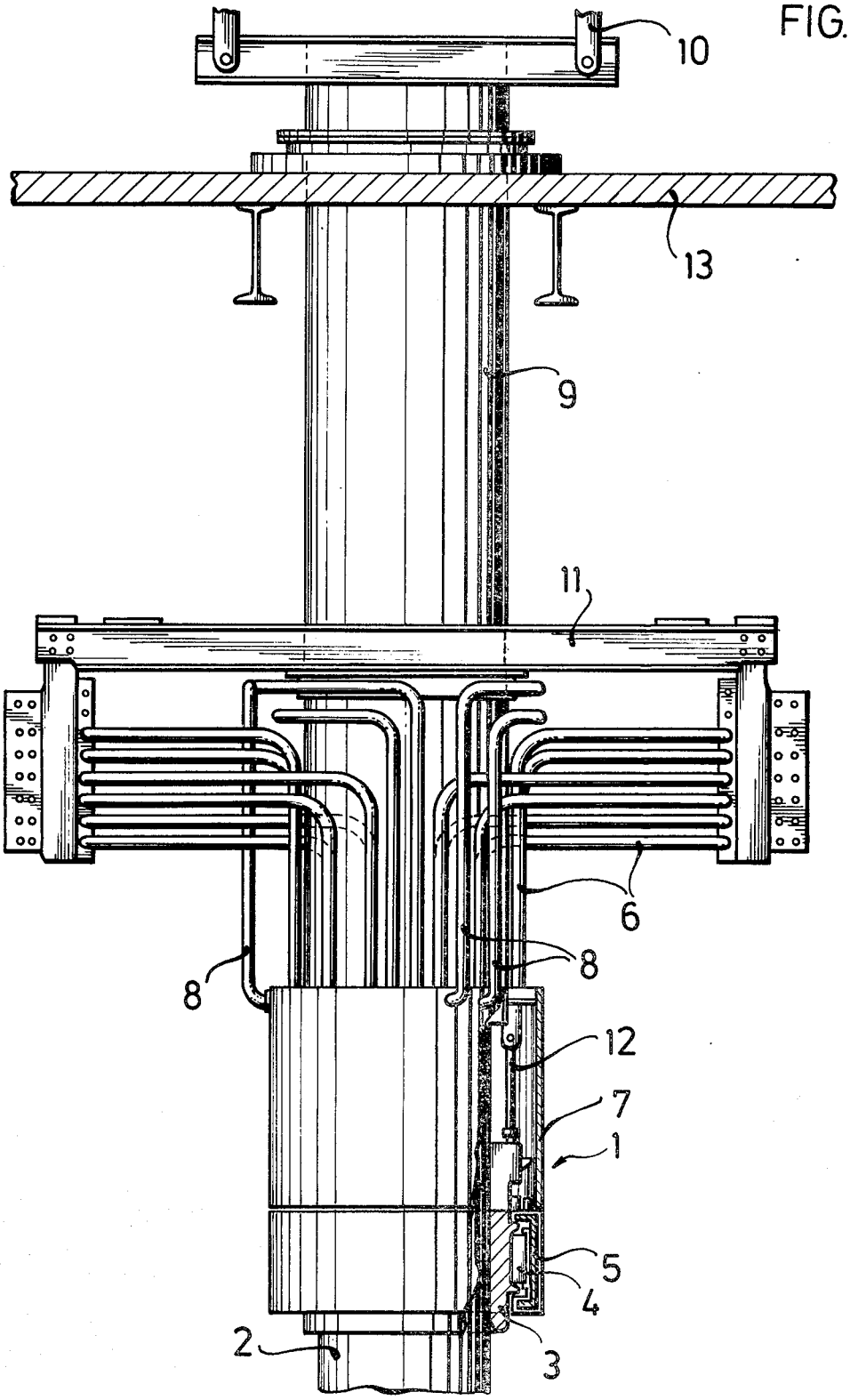
Figure 2:
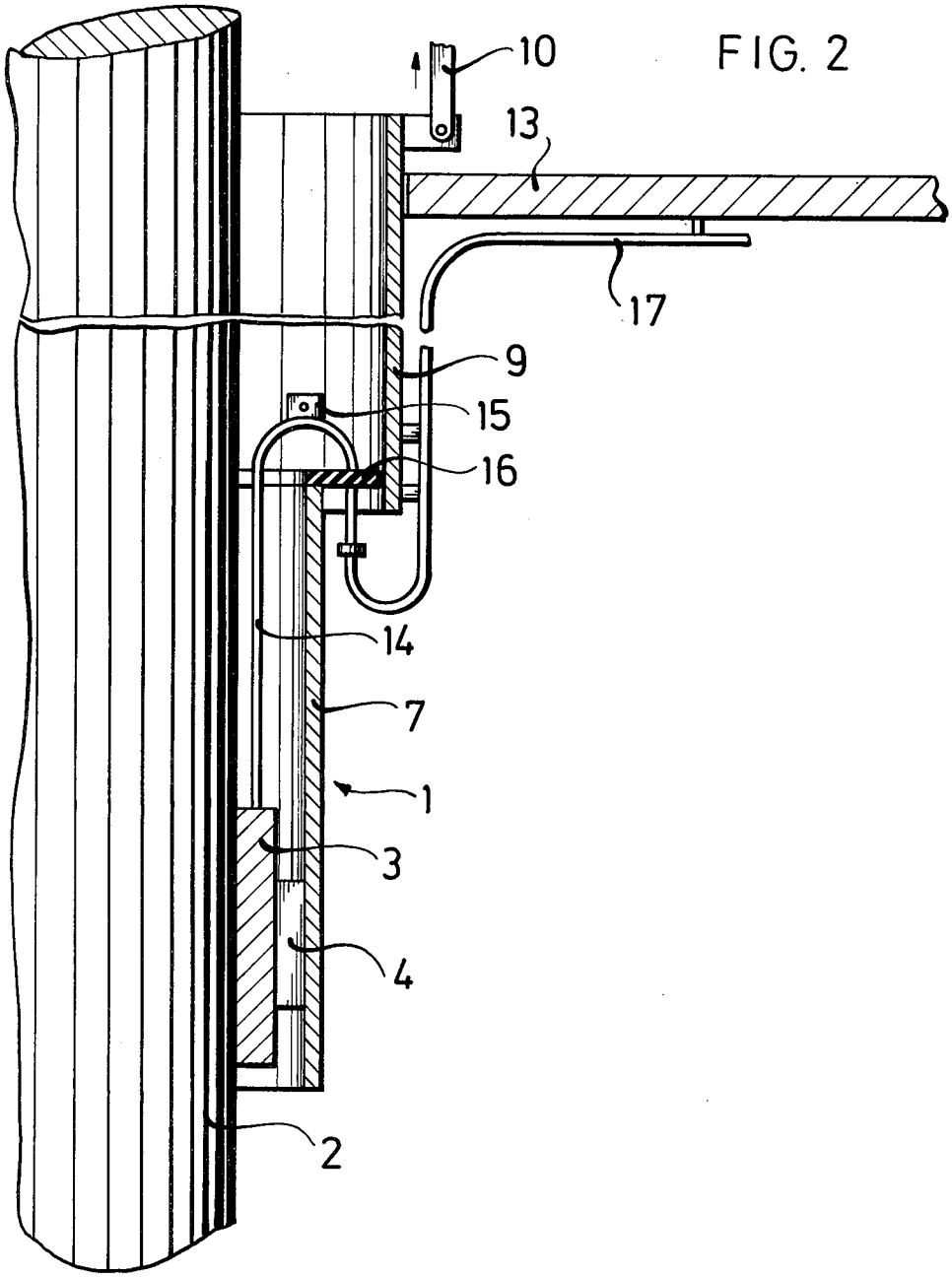

The present invention relates to an assembly for transferring current from a current source to an electrode in an electrothermal smelting furnace, such as a furnace for smelting of ferro alloys, pig iron or carbide. More particularly, but not exclusively, the present invention relates to an electrode holder assembly. The holder assembly comprises a plurality of contact clamps which facilitate contact pressure along the electrode by means of a pressure producing means and an externally arranged member extending circumferential around the electrode. The holder assembly comprises further means for conducting current, coolant and a pressure agent to the holder assembly. In particular, but not exclusively, the present invention is intended to be installed on already installed, conventional furnaces, substituting and modifying the conventional holder system initially installed.

With a device of this type it is important to provide sufficient contact pressure between the holder assembly and the electrode. Further, such holder assembly as an entirety should be made as slim as possible and should be as simple and rigid as possible, reducing as much as possible the required downtime of the furnace caused by maintenance. Further, the various parts of the holder assembly should be easily removable and/or easy to substitute by spare parts. Additionally, the holder assembly and adjacent structural components should be cooled by an internally, circulating coolant.

The conventional holder assembly consists of a plurality of contact clamps evenly distributed along the circumference of the electrode, producing a uniform contact pressure on the electrode by means of a circumferentially arranged pressure ring. The contact pressure is produced by means of hydraulically activated rubber diaphragm or by means of spring devices arranged as an integral part of the pressure ring.

Traditionally, a cooling shield is arranged around the electrode, the cooling shield being arranged on top of the holder assembly supported by the pressure ring. The main purpose of the cooling shield is to limit loss of heat from the furnace and to prevent furnace gases from escaping uncontrolled into the surroundings and rather transport the hot furnace gases to accessory equipment where energy and gas may be retrieved and/or recirculated into the furnace. For this purpose the cooling shield is provided with externally arranged sealing means, closing any openings between the shield and the hood/furnace roof, the sealing means being of a type which permits relative motion between the shield and the hood/furnace roof. It has previously been proposed to use hydraulically activated rubber hoses and an additional flexible layer on the hood/furnace roof as sealing means, thereby providing a flexible sealing between the holder assembly and the openings in the hood/roof through which the electrodes are intended to be moved in axial direction.

The contact clamps, the external pressure ring and the cooling shield are most commonly suspended from a suspension casing surrounding the electrode, the holder assembly being suspended by means of rods, chains, struts, ties etc. The suspension casing is suspended from a winch or the like, enabling the entire holder assembly and consequently the electrode to be hoisted up or down.

The conventional holder assembly as such functions satisfactory. However, the holder assembly is no longer competitive from a production and maintenance point of view.

The object of the present invention is to provide an electrode holder assembly which is as simple as possible both from a constructional and functional point of view and which at the same time is easy to maintain, alternatively to remove/substitute various components.

According to one preferred embodiment the holder assembly is made as single integrated unit where current, coolant and pressure agent are conducted through integrated supplying members, the integrated supplying members also functioning as support for the holder assembly and consequently the electrodes on the suspension means.

Each supplying member is made of at least one tube, for example made of copper, the tube(s) being welded to corresponding tube(s) or plug(s) on the contact clamps. Consequently the tube(s) form(s) a rigid, integrated part of the contact clamps. The contact clamps are provided with internally arranged ducts for communication of coolant and/or pressure agent, said duct(s) communicate(s) with the corresponding tube of the supplying member. As previously pointed out, the supplying member(s) is intended to conduct current, coolant and a pressure agent to the contact clamps. Current is conducted through the copper tubes, while coolant and pressure agent may be conducted through the tubes. Preferably, the pressure agent is circulated through a separate tube, said separate tube preferably being internally arranged within said tube(s) circulating coolant. Hence, the coolant and the pressure agent are circulated in separate, but preferably integrated conduits. It should be appreciated, however, that the coolant also may function as a pressure agent. In the latter case, valves have to be incorporated into the system, providing an adjustable pressure for the pressure producing means.

Water may be used as coolant while oil is preferred as an pressure agent. By arranging the tubes circulating the pressure agent internally within the tubes circulating the coolant, the pressure agent will automatically be cooled by the surrounding, circulating coolant.

According to a further embodiment of the present invention, the pressure producing means form an integral part of the contact clamps while the cooling shield serves the function of the conventional pressure ring, the cooling shield preferably being formed of a single, cylindrical, undivided body. Ducts for circulating coolant are provided within said single, cylindrical, undivided body. The cooling shield surrounds the contact clamps, serving as a thrust member for the pressure producing means arranged on the contact clamps. The cooling shield is for this purpose given sufficient thickness and strength to withstand the thrust excerted by the pressure producing means.

The holder assembly including the cooling shield has preferably a total external diameter which is less than the internal diameter of the suspension casing, whereby the entire holder assembly may be lifted up as an entirety through the suspension casing without having to remove any component of the holder assembly.

The cooling shield is preferably supported by the integrated supply pipes, for example by means of insulating members. The cooling shield extends preferably down to a level below the lower end of the contact clamps. For example the cooling shield may be suspended on the supply pipes by means of a ring, preferably made of glas fiber or corresponding insulating material, the insulating material being rigidly fixed to the shield while the tubes and consequently the contact clamps are allowed to move relative to the shield. Alternatively, also the tubes are rigidly fixed to the shield whereby the entire holder assembly including the cooling shield and the suspension casing will move as a single unit. Flexible tubes allowing such relative motion are provided. According to the present invention a holder assembly which is compact in volume and has a reduced radial extension compared with conventional holder assemblies is provided, the assembly still being simple and not too expensive from the production, purchasing and maintenance point of view.

Further a cooling shield is achieved which in contrast to the conventional solutions is formed preferably as a single, undivided cylindrical body with reduced radial extension. Consequently, a simplified gas tight sealing may be used. It should be appreciated that the conventional sealing means between the pressure ring and the cooling shield is normally relative complex due to the uneven surfaces of the pressure ring and the cooling shield. Said unevenesses are mainly due to the fact that said members are formed of several individual components which are interlocked to form a cylindrical body. The necessity of forming the holder assembly and particularly the pressure ring and/or the cooling shield of separate sections is to enable removal or substitution of the holder assembly or any component of the holder assembly without having to completely close down the furnace.

Further, a solution which may be independent of suspension rods, struts, chains etc. for suspending the holder assembly and thereby the electrode is achieved. Instead of said suspension rods etc. the supply tubes conducting current, coolant and/or pressure agent are used as suspending means.

Further, a solution is provided where the holder assembly may easily be removed and/or substituted by a new holder assembly, whereby the downtime of the furnace is limited to a minimum.

The holder assembly according to the present invention is particularly suited to be installed on furnaces which already have been built and where the internal diameter of the suspension casing is fixed. By substituting the holder assembly originally designed for such furnaces with the holder assembly according to the present invention, easily replaceable holder assemblies may be achieved even on old, conventional furnaces. Due to the reduced lateral diameter of the holder assembly, the holder assembly may easily be replaced, simply by lifting the entire unit up through the space between the electrode and the suspension casing.

A preferred embodiment of the present invention will now be described in further detail in conjunction with the drawings, wherein:

FIG. I shows a partial sectional elevation of a conventional electrode holder assembly with accessory equipment, the figure describing part of the prior art;

FIG. II shows a vertical section through one half of an electrode with an electrode holder assembly in accordance with the present invention associated therewith.

FIG. I shows a partially sectional elevation of a conventional electrode holder assembly 1. Holder assemblies of this type require proper electrical contact between the electrode 2 and the contact clamps 3 of the electrode holder 1. For this purpose the electrode 2 is suspended from a suspension casing by means of a plurality of contact clamps 3, conducting current from a current source to the electrode 2. The contact clamps 3 are interconnected and arranged evenly around the circumference of the electrode 2. The contact clamps 3 are suspended from a suspension casing 9. The clamps 3 are pressed against the electrode 2 by means of pressure producing means 4 forming an integral part of the so-called pressure ring 5, surrounding the clamps 3 and the electrode 2. According to the embodiment shown on figure I the pressure producing means are formed of hydraulically activated rubber diaphragm. Alternatively, the pressure means may be formed of disc springs or similar means.

Current is conducted to the electrode 2 through the contact clamps 3, the clamps communicating with rails 6, suspended from a yoke 11 arranged on the suspension casing 9. Neither the rails 6 communicating with a current source nor the flexibles are shown.

The holder assembly 1 consists further of a cooling shield 7. According to the conventional embodiment shown on FIG. I the cooling shield 7 is formed of a water cooled, cylindrical body surrounding the electrode 2. The shield 7 rests with its lower end on the pressure ring 5. Coolant, which normally is water is circulating through pipes 8 which communicate with a water supply (not shown).

The holder assembly 1 is suspended from the suspension casing 9 by means of rods, ties, struts, chains etc. The suspension casing 9 surrounds the electrode 2. At its upper end the suspension casing is connected to an electrode winch or the like, by means of struts, ties etc. 10. The winch is used to move the electrode holder assembly with contact clamps and consequently with electrode up or down as required.

As shown on FIG. I the electrode 2 with its suspension casing 9 extends upwards through an opening in the upper furnace floor 13.

FIG. II shows a vertical section through one half of an electrode 2, equipped with a holder assembly 1 in accordance with the present invention.

The holder assembly 1 is designed as a single integrated unit where current, coolant and pressure agent are supplied through integrated supply pipes 14, 17. The pipes 14, 17 function further as support/suspension means for the holder assembly 1 and consequently the electrode 2.

The holder assembly 1 comprises a plurality of contact clamps 3 which completely or partially surrounds the electrode 2. The contact clamps 3 are provided with pressure producing means 4. Said pressure producing means may be of any conventional and/or known type. The circumferentially arranged cooling shield 7, preferably in a form of a rigid, undivided body, having internally arranged ducts for circulating a coolant (not shown), surrounds the electrode 2 in the region of the contact clamps 3. The pressure producing means 4 constitute an integral part of the contact clamps 3 and thrust these against the electrode 2, the surrounding cooling shield 7 serving as thrust means for said pressure producing means 4. The cooling shield 7 is for this purpose given sufficient dimensions and strength to resist the radially appearing thrust forces. The cooling shield 7 may alternatively be made up of separate sections which are interconnected, forming a rigid and stiff structure.

According to the present invention the supply pipes 14 are made of pairs of current conducting tubes, for example of copper. The tubes 14 are preferably welded onto the contact clamps 3 and form an integral unit with the contact clamps. The tubes 14 communicates with corresponding ducts (not shown) in the contact clamps 3 for circulation of coolant and/or pressure agent. The coolant and the pressure agent may be circulated in separate ducts. In such case each tube 14 consists either of contiguous tubes rigidly fixed to each other forming a unit or of a main tube for circulating the coolant and an internally arranged secondary tube or pipe for supply of pressure agent to the pressure producing means 4. The contact clamps 3 with the integrated pressure producing means 4 are suspended from the suspension casing by means of said tubes 14, the tubes resting on the supply tubes 17. The supply tubes 17 are rigidly connected to the suspension casing 9. Any conventional means may be used for providing a liquid tight, current conducting connection between the tubes 14, 17. If the coolant and the pressure agent is circulated in different tube, the joint should incorporate a by-pass for the pipe(s) conducting pressure agent. The cooling shield 7 is supported by the tubes 14 through any suitable means (not shown). The pipes may preferably be rigidly fixed to the shield by means of insulating members such as for example a sleeve made for example of plastics materials or glass fiber. Consequently the entire holder assembly including the cooling shield form a single integrated unit which is supported by the pipes 17 fixed on the suspension casing 9. The tubes 17 incorporate a flexible portion allowing relative movement of the holder assembly with respect to the suspension casing and/or the smoke hood 13. The suspension casing 9 is suspended from an electrode winch (not shown) by means of struts, ties etc.

The contact clamps 3 with its pressure producing means 4 and the cooling shield 7 have together a total lateral dimension which is less than the internal diameter of the suspension casing 9. Consequently, the entire holder assembly including the cooling shield 7 may be lifted up as a single unit through the suspension casing 9 without having to remove any components of the holder assembly. In order to enable the holder assembly to be lifted up or lowered down the tubes 14 are equipped with particular lifting means 15 for fastening the ties, struts etc. used for hoisting, the particular lifting means 15 being welded to the tubes 14.

At the upper end of the cooling shield 7, between the cooling shield and the electrode holder assembly, a gas tight sealing mean (not shown) is arranged.

On the embodiment shown on FIG. II, the holder assembly is shown in conjunction with an open or semi-open furnace, the holder assembly being arranged in such a way that the smoke hood 13 is in the region of the suspension casing 9. If applied on a closed furnace, the furnace roof will be in the region of the cooling shield 7.

I claim:

1. A holder assembly for an electrode in an electrothermal smelting furnace, the holder assembly being suspended from a suspension means, the holder assembly comprising: a plurality of contact clamps having pressure producing means disposed adjacent thereto; a cylindrical body externally arranged about the electrode; said contact clamps being arranged between the electrode and said cylindrical body and said pressure producing means being operative to press the contact clamps toward the electrode for holding said electrode; supply means for conducting electrical current, coolant, and pressure agent to said contact clamps; and said supply means also being operative to support the holder assembly on said suspension means.

2. The holder assembly of claim 1 wherein the supply means comprises a plurality of electrical-current conducting tubes also respectively carrying coolant and a pressure agent, said electrical-current conducting tubes being affixed to the contact clamps to support said clamps.

3. The holder assembly of claim 1 wherein the supply means comprises a plurality of electrical-current conducting concentric tubes operative to separately carry coolant and pressure agent in the respective inner and outer channels therein, the concentric tubes being firmly affixed to said contact clamps for support thereof.

4. The holder assembly of claim 3 wherein the coolant is carried in the outer channel whereby the pressure agent is cooled by the coolant.

5. The holder assembly of claim 1 wherein the cylindrical body is a cooling shield which is operative to serve as a thrust member for the pressure-producing means.

6. The holder assembly of claim 1 wherein the suspension means includes a cylindrical body of greater internal diameter than the external diameter of the holder assembly whereby the holder assembly may be lifted through the suspension means.

7. The holder assembly of claim 1 wherein said supply means comprise a first plurality of current-conducting tubes affixed to the contact clamps and a second plurality of current-conducting tubes affixed to the suspension means, said first plurality of current-conducting tubes resting on the second plurality of tubes for supporting said first plurality of current-conducting tubes whereby said contact clamps are supported by said suspension means.

8. A holder assembly for an electrode in an electrothermal smelting furnace, the holder assembly being suspended from a cylindrical suspension means; the holder assembly comprising: a plurality of contact clamps having pressure-producing means integral therewith, a cylindrical cooling shield of outer diameter less than said cylindrical suspension means; said contact clamps being arranged between the electrode and the cylindrical cooling shield and wherein said pressure-producing means are operative to press the contact clamps toward the electrode; a first polarity of current-conducting tubes affixed to said contact clamps; a second plurality of current-conducting tubes affixed to said suspension means; said first plurality of tubes resting on said second plurality of tubes for supporting the contact clamps on the suspension means; said first and second plurality of tubes also being arranged to continuously carry in respective tubes cooling fluid and pressure agent for cooling the contact clamps and for actuation of the pressure-producing means.

* * * * *

UNITED STATES PATENT AND TRADEMARK OFFICE

CERTIFICATE OF CORRECTION

PATENT NO. : 4,434,496

DATED : February 28, 1984

INVENTOR(S) : Harald Krogsrud

It is certified that error appears in the above-identified patent and that said Letters Patent is hereby corrected as shown below:

On the title page Insert

-- (73) Assignee: Elkem a/s, Oslo, Norway --.

Signed and Sealed this

Eleventh Day of November, 1986

*Attest:*

DONALD J. QUIGG

*Attesting Officer*

*Commissioner of Patents and Trademarks*